US008262401B1

(12) United States Patent
Byrne

(10) Patent No.: US 8,262,401 B1
(45) Date of Patent: Sep. 11, 2012

(54) FOUR-WAY RACEWAY CONNECTOR

(76) Inventor: Norman R. Byrne, Ada, MI (US)

( * ) Notice: Subject to any disclaimer, the term of this patent is extended or adjusted under 35 U.S.C. 154(b) by 0 days.

(21) Appl. No.: 13/042,084

(22) Filed: Mar. 7, 2011

(51) Int. Cl.
*H01R 4/60* (2006.01)

(52) U.S. Cl. ..... 439/215

(58) Field of Classification Search ..... 439/215, 439/210, 115, 650, 651, 654, 628
See application file for complete search history.

(56) References Cited

U.S. PATENT DOCUMENTS

| | | | | | |
|---|---|---|---|---|---|
| 1,568,156 | A | * | 1/1926 | Herskovitz | 439/652 |
| 2,508,770 | A | * | 5/1950 | Oshinsky | 337/189 |
| 4,313,646 | A | * | 2/1982 | Millhimes et al. | 439/654 |
| 4,367,417 | A | * | 1/1983 | Casasanta | 307/147 |
| 4,795,379 | A | | 1/1989 | Sasaki | |
| 4,990,110 | A | | 2/1991 | Byrne | |
| 5,127,842 | A | * | 7/1992 | Kelly | 439/165 |
| 5,277,609 | A | * | 1/1994 | Ondrejka | 439/215 |
| 5,383,799 | A | * | 1/1995 | Fladung | 439/652 |
| 5,443,400 | A | * | 8/1995 | Brown et al. | 439/650 |
| 5,888,105 | A | * | 3/1999 | Brown et al. | 439/857 |
| 5,911,600 | A | * | 6/1999 | Mosquera | 439/655 |
| 5,941,720 | A | | 8/1999 | Byrne | |
| 6,220,897 | B1 | * | 4/2001 | Maxwell | 439/652 |
| 6,929,514 | B1 | * | 8/2005 | Chuang | 439/652 |
| 7,371,121 | B1 | * | 5/2008 | Lee | 439/650 |
| 7,371,122 | B2 | * | 5/2008 | Ivanova et al. | 439/652 |
| 7,520,783 | B2 | * | 4/2009 | Chou et al. | 439/652 |
| 7,892,036 | B2 | * | 2/2011 | Lee | 439/638 |

* cited by examiner

*Primary Examiner* — Amy Cohen Johnson
*Assistant Examiner* — Vladimir Imas
(74) *Attorney, Agent, or Firm* — Varnum, Riddering, Schmidt & Howlett LLP

(57) ABSTRACT

A raceway connector (300) includes a first vertical terminal set (302) and a second vertical terminal set (310). Each vertical terminal set (302, 310) includes double end terminals (304) with first and second female connectors (306, 308). The vertical terminal sets (302, 310) are held in position by a left-outside housing (314), a center connector (328) and a right-side housing (324). The raceway connector (300) is adapted to be interconnected to four junction blocks (344).

8 Claims, 11 Drawing Sheets

FOUR-WAY RACEWAY CONNECTOR

CROSS-REFERENCE TO RELATED APPLICATIONS

Not applicable.

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO A SEQUENCE LISTING

Not Applicable.

FIELD OF THE INVENTION

The invention relates generally to electrical terminals and, more particularly, to a multiple-tiered connector configuration for use in raceways to provide four-way multiple terminal connections.

BACKGROUND OF THE INVENTION

Historically, various types of assemblies have been developed for electrically and conductively interconnecting devices to be electrically energized to sources of electrical power. For example, it is well known to provide various spatial areas of residential, commercial and industrial establishments with electrical receptacle units permanently (through fuses, circuit breakers or other emergency shut-off elements) conductively connected to one or more sources of main utility power. Each of the receptacle units typically comprises one or more engaging assemblies often referred to by the colloquial term "female receptacle."

These receptacle units are conventionally mounted in stationary walls or, alternatively, in the case of modern and modular office furniture systems, in moveable wall panels or even within work surfaces. Devices to be electrically energized often comprise receptacle plugs having two or more prongs or blade terminals adapted to be conductively engaged within the female receptacles. The prongs or blade terminals are conventionally referred to by the colloquial terms "male" plugs, prongs, blades or terminals. The receptacle plugs are typically interconnected to the circuitry of the device so as to be energized by wires extending through flexible insulative cords or the like. This type of male/female electrical interconnection configuration to provide removable or releasable conductive engagement is utilized in a myriad of electrical connector arrangements. For example, in addition to electrical energization of relatively large and discrete devices (such as lamps, televisions, stereos, typewriters, etc.), male/female interconnection configurations are also utilized internally in electrical devices such as computers and associated peripherals. In addition, male/female electrical interconnection arrangements are also utilized in a number of other applications, such as internal circuit wiring for electrical apparatus of modular office systems and the like.

In the design of male/female electrical interconnection configurations, it is of primary importance to provide a secure and stationary electrical contact between the conductive surfaces of the elements of the electrical receptacle and the conductive surfaces of the prongs or blade terminals. It is also of primary importance to provide surface connections having relatively little resistance. In view of the foregoing, various types of interfaces have been developed for engaging male prongs or blade terminals with mating female receptacles. For example, it is known to utilize an opposing pair of cantilever beams within the female receptacle, which provide a single point of contact on each side of an inserted male terminal. Other known arrangements include the use of single cantilever spring pressure, backed with a steel or similar spring supported within a plastic housing. This type of arrangement will conventionally provide a single point of contact at the electrical interface.

It has become known that it is preferable to provide as many interface points of contact as is reasonably possible, while still maintaining a releasable engagement. For example, an arrangement for providing four contact points is disclosed in Sasaki et al., U.S. Pat. No. 4,795,379 issued Jan. 3, 1989. The Sasaki et al, patent refers to the concept that it has been known to utilize certain types of electrical connections in computers, telecommunications equipment and other data processing equipment, which are in the form of a receptacle contact having four resilient cantilever contact members extending forwardly from a base. The contact members are adapted to provide an electrical connection with a tab contact inserted from the front of the receptacle unit.

The tab contact is electrically engaged by four leaves from four directions. The four leaves can be arranged as opposing pairs, with each pair arranged orthogonally.

In this type of arrangement, electrical engagement is made with the tab contact at four points, thereby increasing reliability of the receptacle contact relative to a contact arrangement having only two contact points. Sasaki et al. also explains that a problem can arise in that a possibility of an incomplete electrical engagement can be caused by foreign matter on the surface of the tab contact. In addition, one of the pairs of contact members may engage the edge surfaces of the tab contact. The edge surfaces of the tab contact are typically the surface edges formed when the contact is made by stamping a sheet of conductive material. The surfaces are often rough in comparison with the planar rolled or formed surface of the sheet, and thus have a lower contact reliability. Accordingly, these contact members may not provide a reliable electrical connection, and a greater insertion force may be required at the time of insertion.

As an improvement, Sasaki et al. describes a receptacle contact having opposed leaf spring members formed by two parallel plates linked through a U-shaped portion extending between adjacent sides of the leaf spring members. The leaf spring members include first spring arms and second spring arms formed integrally with the spring members.

The first spring arms and second spring arms are opposed to each other, and outer contact and inner contact members are formed at the free ends of the spring arms, which are also opposed to each other. Additional contact members are located to the rear of the first set of contact members. The spring arms extend side by side from the leaf spring members, with the outer contact members being slightly twice the width of the inner contact members. The contact members are arcuate to facilitate insertion of a tab contact therebetween.

The receptacle contact described in Sasaki et al. is formed by stamping from a suitable metal sheet having the desirable conductive and spring characteristics. The stamping process is performed by shaping the metal sheet in an appropriate configuration, and then folding the spring arms to the shape required, while folding another portion into a U-shape. In use, the tip of a tab contact can be inserted into the space between the outer contact members opposed to each other at the front portion of the receptacle contact. Upon insertion, upper and lower surfaces of the contact are brought into a wiping engagement with the outer contact members. Accordingly, foreign matter on upper and lower surfaces of the contact is removed. When the contact is inserted further, the upper and lower surfaces which have been cleaned by the outer contact members are also wipingly engaged by the inner contact members. In this manner, a relatively greater electrical connection reliability between the tab contact and the inner contact members is provided. In addition, the outer contact members and inner contact members are in electrical engagement with in upper and lower planar surfaces of the tab contact, and not with side surfaces which may comprise the cut edge surfaces of the contact. Accordingly, this decreases the force needed to insert the contact into the receptacle contact, thereby improving reliability of electrical connection.

In addition, the length of the spring arms which provide the contact force created between the outer contact members and the tab contact, is longer than the length of the spring arms which provide the contact force between inner contact members and the tab contact. Accordingly, the insertion force is reduced by reducing the contact force created between the tab contact and the outer contact members, which clean the upper and lower surfaces of the tab contact. In this manner, the initial insertion force of the tab contact within the outer contact members is less than the insertion force of the inner contact members.

The electrical terminals described above can be utilized with various types of connector configurations having multiple tiers. In particular, it would be advantageous for having common electrical terminals which can be used in four-way multiple terminal configurations.

SUMMARY OF THE INVENTION

In accordance with the invention, a raceway connector is adapted to conductively receive and transmit electrical power. The raceway connector includes first means for receiving power from an external source. Second means are conductively connected to the first means for transmitting the power and applying the power to external components. The first means comprises a first terminal, and the second means comprises three terminals identified as second, third and fourth terminals. The first, second, third and fourth terminals are each conductively connected to each other. Further, each of the first, second, third and fourth terminals can have incoming power means for receiving incoming power from the external source.

The first terminal extends outwardly from the raceway connector in a first direction. The second terminal extends outwardly in a second direction, the second direction being parallel to the first direction. The third terminal extends outwardly from the raceway connector in a third direction, with the third direction being at an angle of 180° relative to the first direction. The fourth terminal extends outwardly from the raceway connector in a fourth direction. The fourth direction is at an angle of 180° relative to the first direction.

The connector also includes a series of four-way terminal sets. Each of the terminal sets is disposed above or below an adjacent one of the terminal sets, and each of the terminal sets includes a first terminal, second terminal, third terminal and fourth terminal. Still further, each of the terminal sets is isolated from each of the other of the series of terminal sets. In addition, the number of terminal sets is eight.

The raceway connector can include a first vertical terminal set formed as a series of vertically disposed first terminals, along with a second vertical terminal set formed as a set of second terminals. A third vertical terminal set is formed as a set of the third terminals, and a fourth vertical terminal set is formed as a series of four terminals. Still further, each of the first, second, third and fourth terminals is a female terminal.

Also in accordance with the invention, the raceway connector can include a series of horizontally disposed four-way terminal sets, with each of the terminals sets comprising first, second, third and fourth terminals. The raceway connector can further include a connector housing having individual housings for each terminal of the raceway connector. In accordance with another aspect of the invention, the first, second, third and fourth terminals can each include upper means extending forwardly, and having a lower surface with at least first, second and third upper contact locations formed thereon. Lower means extend forwardly and conductively interconnect to and are positioned substantially directly below the upper means. The lower means has an upper surface with at least first, second and third lower contact locations formed thereon. Each terminal is sized and configured so that a blade terminal is insertable between the upper means and the lower means, and is adapted to conductively contact the terminal at the first, second and third upper and lower contact locations, so as to form at least six conductive and electrical contact locations with the terminal.

BRIEF DESCRIPTION OF THE DRAWINGS

An illustrative embodiment of the invention will now be described with respect to the drawings, in which:

FIG. 18 is a rear, upside down view of the four-way raceway connector shown in

FIG. 13;

DETAILED DESCRIPTION OF THE PREFERRED EMBODIMENT

The principles of the invention will now be disclosed, by way of example, in a four-way raceway connector 300 as illustrated in FIGS. 13-22. However, prior to a detailed description of the connector 300, a prior art electrical contact unit 100 will be described herein with respect to the illustrations shown in FIGS. 1-9. The electrical contact unit 100 was the subject of commonly owned U.S. Pat. No. 4,990,110 issued to Byrne, and dated Feb. 5, 1991. Following the description of the contact unit 100, a description of a five-way connector 200 is set forth in the following paragraphs, and illustrated in FIGS. 10, 11 and 12. After the general description of the five-way raceway connector 200, the four-way raceway connector 300 will be described.

The contact unit 100 as described herein provides at least six locations of contact with respect to the electrical engagement of male blade terminals with the electrical contact unit. In addition, the contact unit 100 also provides a triangular positioning of contact points so as to maintain a stable electrical connection between the blade terminals and the elements of the electrical receptacles.

Figure 1:
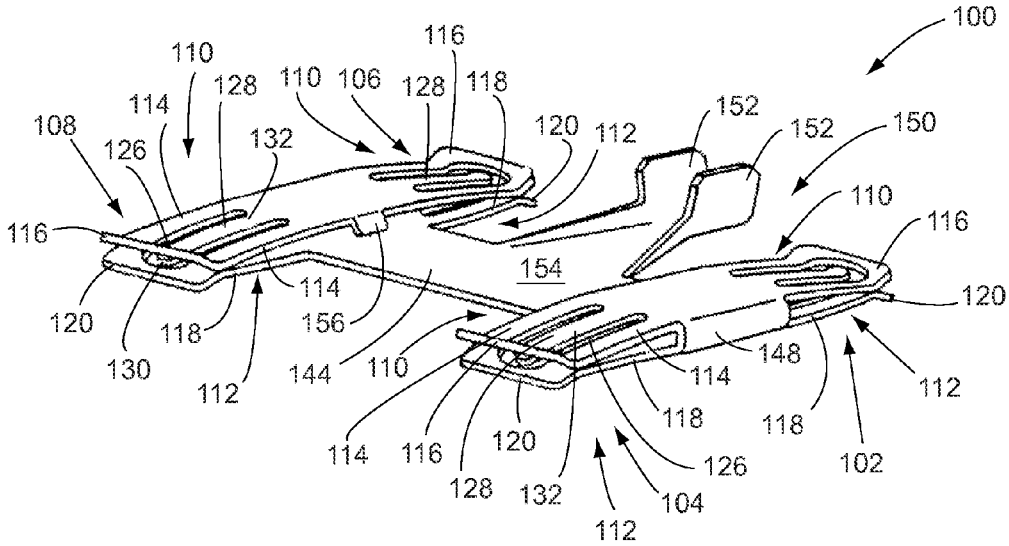
Fig. 1 (Prior Art)
FIG. 1 is a perspective view of a prior art electrical contact arrangement.

Referring primarily to FIG. 1, the electrical contact unit 100 includes a series of four electrical receptacles 102, 104, 106 and 108. As illustrated in FIGS. 1-6, each electrical receptacle 102, 104, 106 and 108 includes an outer, elongated and upper cantilever member 110, and an opposing lower cantilever member 112. The upper cantilever members 110 each include a pair of lateral and parallel elongated arms 114 integrally connected at their forward ends by a bridge portion 116. Correspondingly, each of the lower cantilever members 112 includes corresponding lateral arms 118 integrally connected at their forward ends by a lower bridge portion 120.

Figure 3:
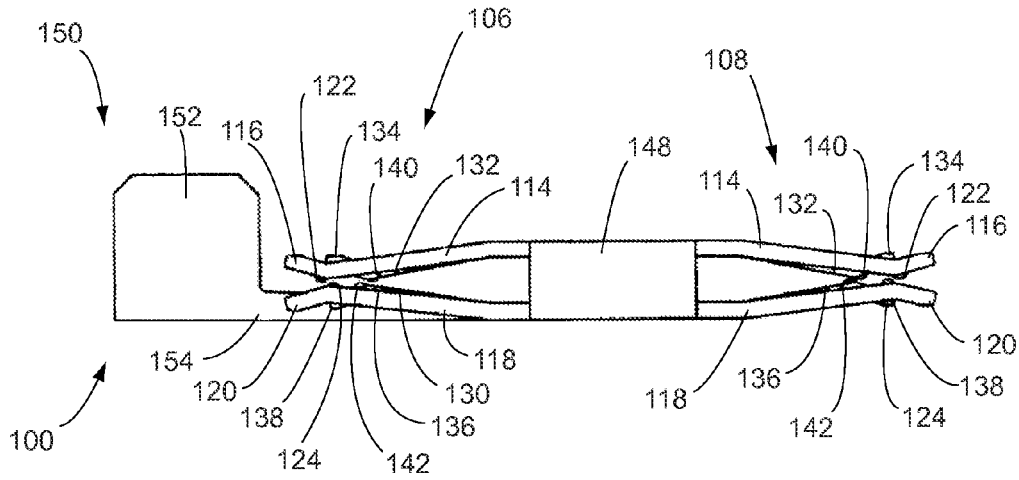
Fig. 3 (Prior Art)
FIG. 3 is a side view of the contact arrangement shown in FIG. 1.
Figure 4:
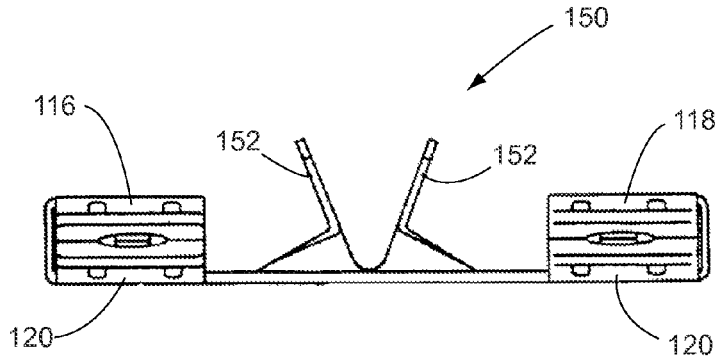
Fig. 4 (Prior Art)
FIG. 4 is an end view of the contact arrangement shown in FIG. 1.
Figure 6:
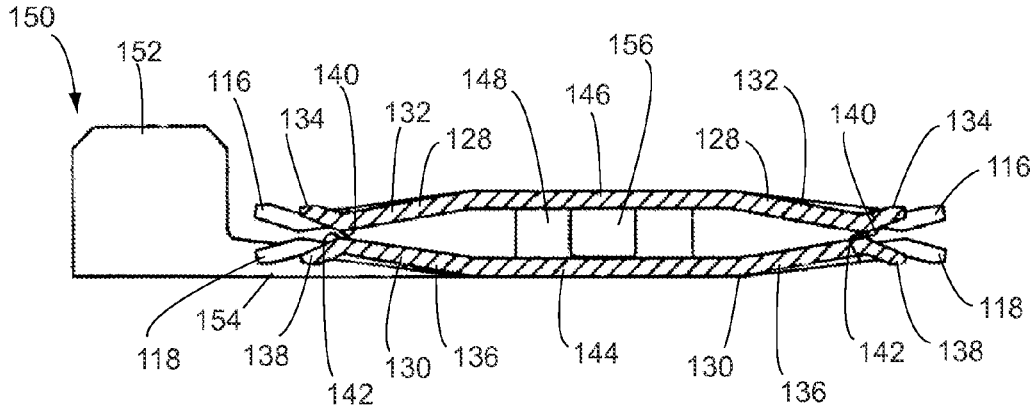
Fig. 6 (Prior Art)
FIG. 6 is a sectional view of the contact arrangement, taken along section lines 6-6 of FIG. 2.

As illustrated primarily in FIGS. 3 and 6, the upper lateral arms 114 have a slight downwardly angled configuration, while the upper bridge portion 116 is angled slightly upwardly. With this configuration, a contact surface or edge 122 is formed at the integral interface between the upper bridge portion 116 and each of the lateral arms 114. Correspondingly, the lateral arms 118 of the lower cantilever members 112, as further illustrated in FIGS. 3 and 6, are angled slightly upwardly, while the lower bridge portion 120 is angled slightly downwardly. With this configuration, a contact surface or edge 124 is provided at the interface between the integrally connected lateral arms 118 and lower bridge portion 120.

Figure 2:
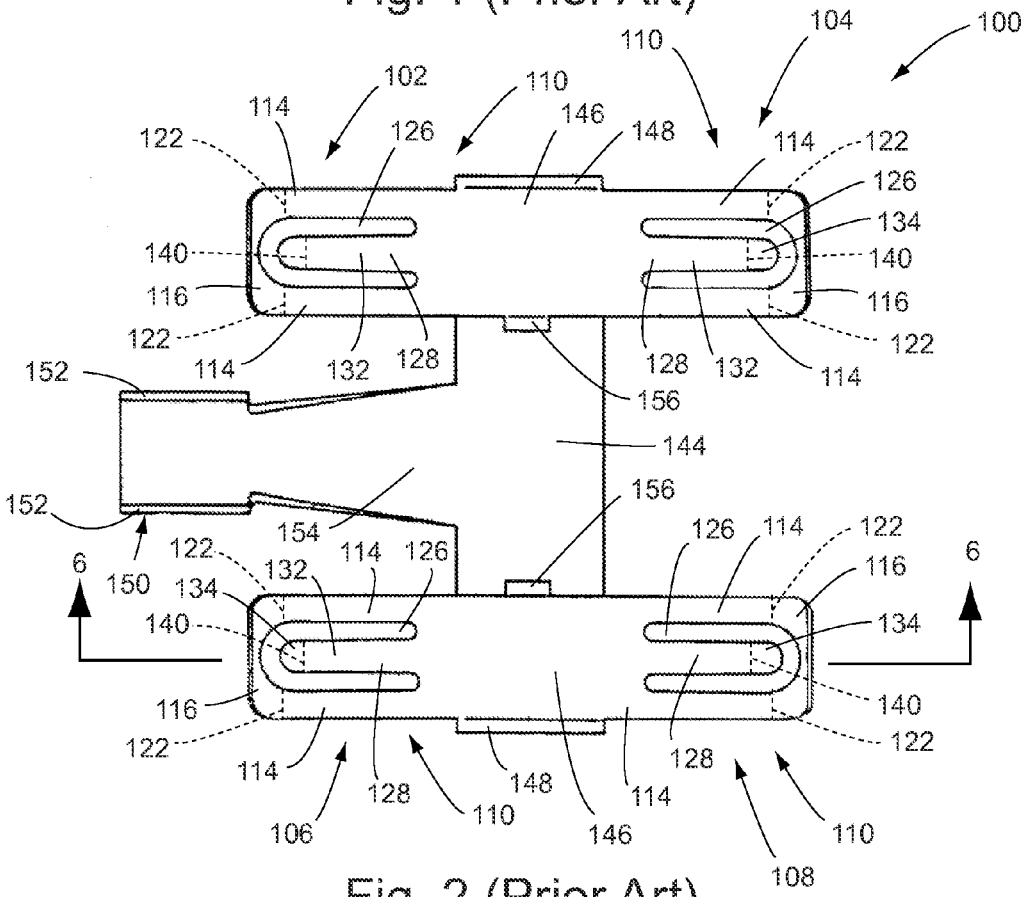
Fig. 2 (Prior Art)
FIG. 2 is a top plan view of the contact arrangement shown in FIG. 1.
Figure 5:
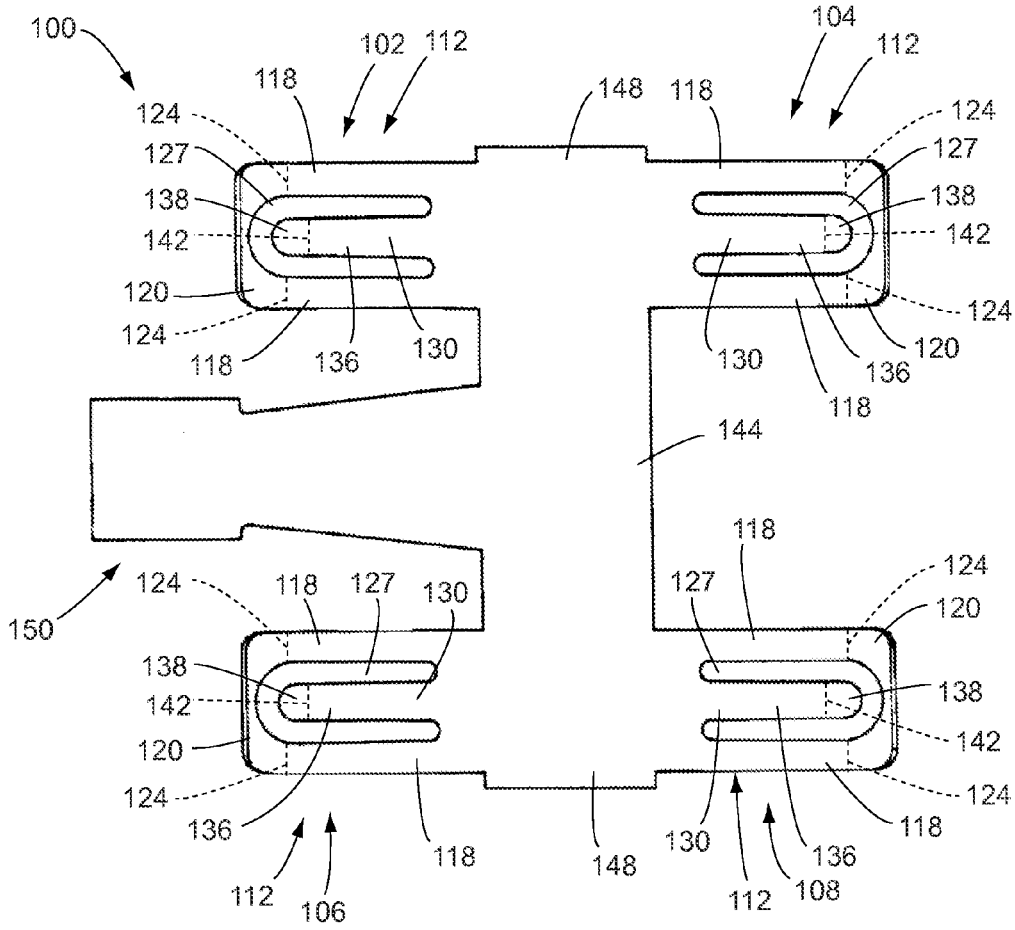
Fig. 5 (Prior Art)
FIG. 5 is an underside view from the opposing side of the contact arrangement shown in FIG. 2.

As shown primarily in FIGS. 2 and 5, the lateral arms 110 and bridge portion 116 of the upper cantilever members 110 form an arcuate spatial area 126 internal to the arms 114 and upper bridge portion 116. A similar spatial area 127 is formed by the lateral arms 118 and lower bridge portion 120 of the lower cantilever members 112. With respect specifically to FIG. 2, each of the receptacles 102, 104, 106 and 108 also include an inner and upper cantilever member 128 which extends forwardly within the spatial area 126 formed by the lateral arms 114 and bridge portion 116. An opposing inner cantilever member 130 is formed within the corresponding spatial area 127 of the lower cantilever members 112 and also extends forwardly. As illustrated primarily in FIGS. 3 and 6, each of the upper cantilever members 128 is resilient in structure and has a rear downwardly angled portion 132 integrally connected at the forward portion thereof to a forward upwardly angled portion 134. Correspondingly, each of the lower and inner cantilever members 130 includes a rear upwardly angled portion 136 integrally connected at its forward end to a forward downwardly angled portion 138. The interface between the rear downwardly angled portion 132 and forward upwardly angled portion 134 of the upper cantilever member 128 forms a contact surface or edge 140. Correspondingly, a contact surface or edge 142 is formed at the interface between the integrally connected rear upwardly angled portion 136 and forward downwardly angled portion 138 of the lower cantilever members 130.

The opposing upper and lower cantilever members 110, 112 and the opposing inner cantilever members 128, 130 are flexible and resilient in nature so as to be appropriately flexed when a male blade terminal (illustrated in FIGS. 7-9) is inserted between the opposing cantilever members. In addition, as will be further apparent from additional description herein, the contact surfaces 122 and 140 associated with the upper cantilever member 110 and the upper cantilever member 128 form a triangular contact surface configuration with the male blade terminal. Correspondingly, the contact surfaces 124 and 142 form an opposing triangular contact surface configuration, thereby providing six points of contact between the electrical receptacles 102, 104, 106 and 108 and the inserted male blade terminal. This triangular configuration provides a substantial stabilizing effect to the interconnection between the male blade terminal and the electrical receptacles, while correspondingly providing six points of contact. Referring again primarily to FIGS. 1, 2 and 5, the four-receptacle unit 100 includes a connecting beam 144 central to and symmetrically located relative to the receptacles 102, 104, 106 and 108. The connecting beam 144 is rectangular in configuration and is integrally connected to each of two secondary connecting portions 146 by means of a U-shaped connecting portion formed at each of the ends of the connecting beam 144. Each of the secondary connecting portions 146 also forms an integral inner support portion for the upper cantilever members 110 and the upper cantilever members 128.

As further illustrated in FIGS. 1, 2 and 5, the four-receptacle unit 100 includes a common terminal input channel 150 having a pair of crimp wings 152 integrally formed at the lateral sides of the channel 150. The channel 150 includes a transition portion 154 integrally connecting the common terminal input channel 150 with the connecting beam 144. In addition to the foregoing, the receptacle unit 100 also includes a pair of tabs 156 each formed on one side of each of the secondary connecting portions 146. These tabs 156 provide a means for controlling positioning of the "boxes" formed by the surfaces of the connecting beam 144, secondary connecting portions 146 and U-shaped connecting portions 148.

Figure 7:
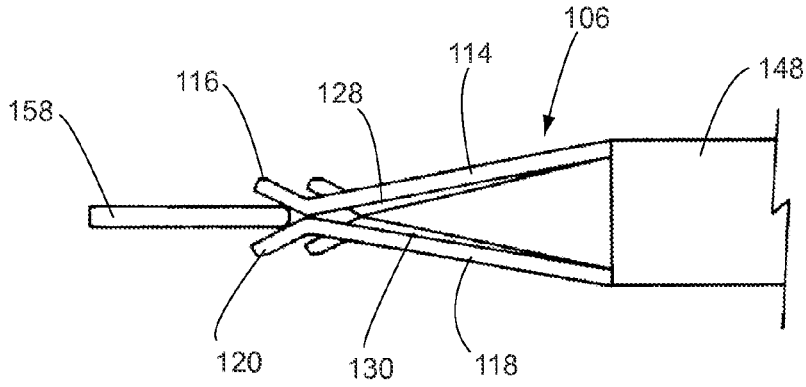
Fig. 7 (Prior Art)
FIG. 7 is a side view showing an example insertion arrangement of a blade terminal into the contact arrangement.
Figure 8:
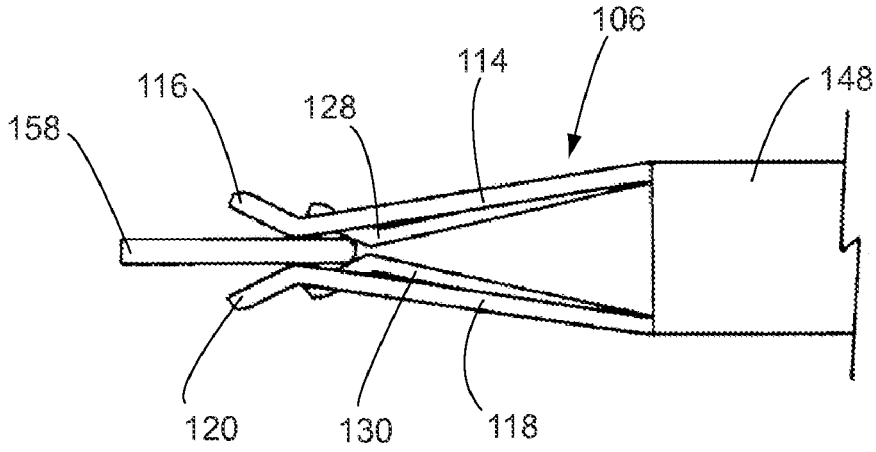
Fig. 8 (Prior Art)
FIG. 8 is an illustration similar to FIG. 7, showing further insertion of the blade terminal.
Figure 9:
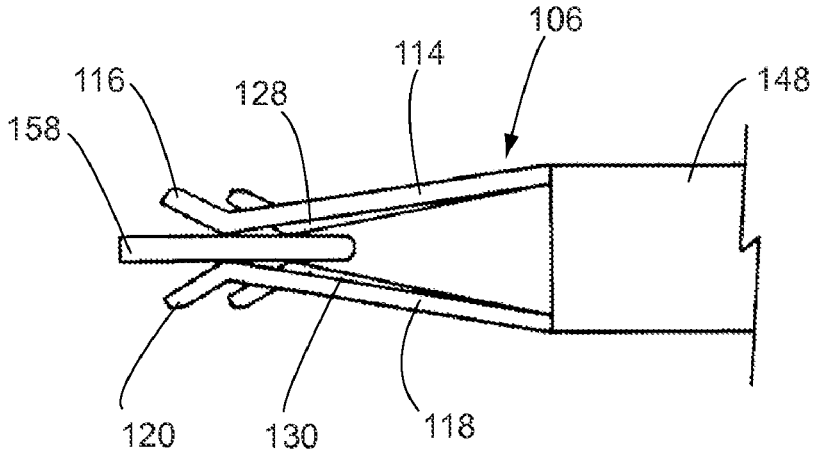
Fig. 9 (Prior Art)
FIG. 9 is an illustration similar to FIG. 8, showing final position insertion of the blade terminal.

The use of the electrical contact unit 100 with corresponding insertion of a male blade terminal 158 will now be described with respect to FIGS. 7-9. The male blade terminal or tab contact 158 may, as illustrated in FIGS. 7, 8 and 9, include tapered surfaces at its forward portion for purposes of facilitating insertion into the electrical receptacles 102, 104, 106 and 108. For purposes o illustration, FIGS. 7, 8 and 9 only illustrate one of the electrical receptacles 106. The forward portion of the blade terminal 158 is first inserted into the spatial area formed between the upper bridge portion 116 and lower bridge portion 120. As the blade terminal 158 is inserted, upper and lower surfaces of the terminal 158 will contact the upper contact surfaces 122 and lower contact surfaces 124 formed at the interface between the bridge portions 116, 118 and the lateral arms 114, 118. As the blade terminal 158 is further inserted, the forward portion of the terminal 158, at its upper and lower surfaces near the central portions thereof, will engage in an electrical contact with the contact surfaces 140, 142 formed at the interfaces of the integrally connected downwardly angled portion 132 and forwardly and upwardly angled portion 134 of the upper cantilever member 128, and the interface between the integrally connected upwardly angled portion 136 and downwardly angled portion 138.

As previously described, the upper contact surfaces 122 and 140 provide a triangular configuration, with three locations of electrical contact. This triangular configuration provides a substantial stabilizing effect which prevents relatively poor contact if the interconnection between the male blade terminal 158 and the corresponding receptacle is jarred or otherwise subjected to a "rocking" movement. Correspondingly, the three locations of lower contact provided by the contact surfaces 124 and 142 provide a corresponding triangular contact surface configuration opposing the upper contact configuration. With the three points of lower contact, the interconnection and engagement between the male blade terminal 158 and the corresponding electrical receptacle is provided with six locations of contact. Still further, if the male blade terminal 158 is appropriately sized relative to the relative positioning of the bridge portions 116, 120, the surfaces of the bridge portions 116, 120 will provide a "wiping" engagement with the central portion of the upper and lower surfaces of the blade terminal 158. This wiping engagement will ensure that the central portion of the blade terminal 158 which will be in electrical contact with the upper and inner cantilever member 128 and lower and inner cantilever member 130 will be free from any foreign matter as a result of the "cleaning" function carried out by the bridge portions 116, 118. With the six locations of contact provided for each of the electrical receptacles 102, 104, 106 and 108, the electrical, current-carrying capability of the receptacles is greatly improved. In addition, with respect to the particular four-receptacle unit 100 illustrated herein, four receptacles are provided with the necessity of only a single wire crimp configuration in an integral terminal, thereby providing an efficient use of space within a connector system. Still further, the triangular positioning of the three locations of contact on each of the upper and lower surfaces of the male blade terminal provide a substantially "steady" platform for the male blade terminal 158.

As apparent from the foregoing, the electrical connector unit 100 can be formed from a suitable metal sheet by means of stamping and forming the unit 100, with the sheet having the appropriate conductive and spring and resiliency characteristics. Such a stamping process can be achieved by utilizing a suitably formed metal sheet, and then folding over the elements forming the upper cantilever members 110 and the secondary connecting portions 146.

The raceway connector 200 will now be described primarily with respect to FIGS. 10, 11 and 12. To the extent appropriate for description and clarity, components of the raceway connector 200 which correspond to components of the electrical contact unit 100 will use identical reference numericals. Referring to the drawings, and first with respect to FIG. 12, the raceway connector 200 includes a series of eight horizontally disposed five-way female terminal sets 202. Each of the terminal sets 202 includes five female terminals, identified as a first terminal 204, second terminal 206, third terminal 208, fourth terminal 210 and fifth terminal 212. Each of these female terminals 204-212 includes an outer, elongated and upper cantilever member 214 and an opposing cantilever member 216. The upper cantilever members 214 each include a pair of lateral and parallel elongated arms 218 integrally connected at their forward end by a bridge portion 220. Correspondingly, each of the lower cantilever members 216 includes corresponding lateral arms 222 integrally connected at their forward ends by a lower bridge portion 224.

Each of the upper lateral arms 218 can have a slight downwardly angled configuration, while the upper bridge portion 220 is angled slightly upwardly. With this configuration, a contact surface or edge 226 is formed at the integral interface between the upper bridge portion 220 and each of the lateral arms 218. Correspondingly, the lateral arms 222 of the lower cantilever members 216 are angled slightly upwardly, while the lower bridge portion 224 is angled slightly downwardly. With this configuration, a contact surface or edge 228 is provided at the interface between the integrally connected lateral arms 222 and the lower bridge portion 224.

As with the prior art, it is possible to utilize lateral arms, bridge portions and cantilever portions which form an arcuate spatial area 230 internal to the arms and upper bridge portion. A similar spatial area can be formed by the lower lateral arms and the lower bridge portion of the lower cantilever members. Also, each of the female terminals 204-212 can include an inner and upper cantilever member 232 which extends forwardly within the spatial area 230 formed by the lateral arms 218 and bridge portion 220. An opposing inner cantilever member is formed within the corresponding spatial area of the lower cantilever members 216 and also extends forwardly. Each of the upper cantilever members 232 can be resilient in nature and have a rear downwardly angled portion integrally connected at the forward portion thereof to a forward upwardly angled portion. Correspondingly, each of the lower and inner cantilever members 234 can include a rear upwardly angled portion integrally connected at its forward end to a forward downwardly angled portion. The interface between the rear downwardly angled portion and forward upwardly angled portion of the upper cantilever member 232 forms another contact surface or edge. Correspondingly, a further contact surface or edge is formed at the interface between the integrally connected rear upwardly angled portion and forward downwardly angled portion of the lower cantilevered members.

The opposing upper and lower cantilever members 214, 216 and the opposing inner cantilever members 232, 234 are flexible and resilient in nature, so as to be appropriately flexed when a male blade terminal is inserted between the opposing cantilever members. In addition, the contact surfaces associated with the upper cantilever member 214 and the upper cantilever member 232 form a triangular contact surface configuration with the male blade terminal. Correspondingly, the contact surfaces associated with the lower portion of each female terminal form an opposing triangular contact surface configuration. In this manner, six points of contact between the female terminals and the male blade terminal are provided.

In addition to the raceway connector 200 having a series of eight horizontally disposed five-way female terminal sets 202, the raceway connector 200 also forms a series of vertical female terminal sets. Specifically, and again with reference to FIGS. 10 and 12, five vertically aligned female terminal sets are provided by the eight five-way female terminal sets 202. Specifically, and particularly with reference to FIG. 12, these vertically disposed terminal sets are identified as first vertical female terminal set 250, second vertical female terminal set 252, third vertical female terminal set 254, fourth vertical terminal set 256 and fifth vertical terminal set 258. The first vertical terminal set 250 is made up of the eight first female terminals 204, while the second vertical terminal set 252 is made up of the eight second female terminals 206. Correspondingly, the third vertical female terminal set 254 is made up of the third female terminals 208, and the fourth vertical female terminal set 256 consists of the fourth female terminals 210. Further, the fifth vertical female terminal set 258 consists of the fifth female terminals 212.

Figure 12:
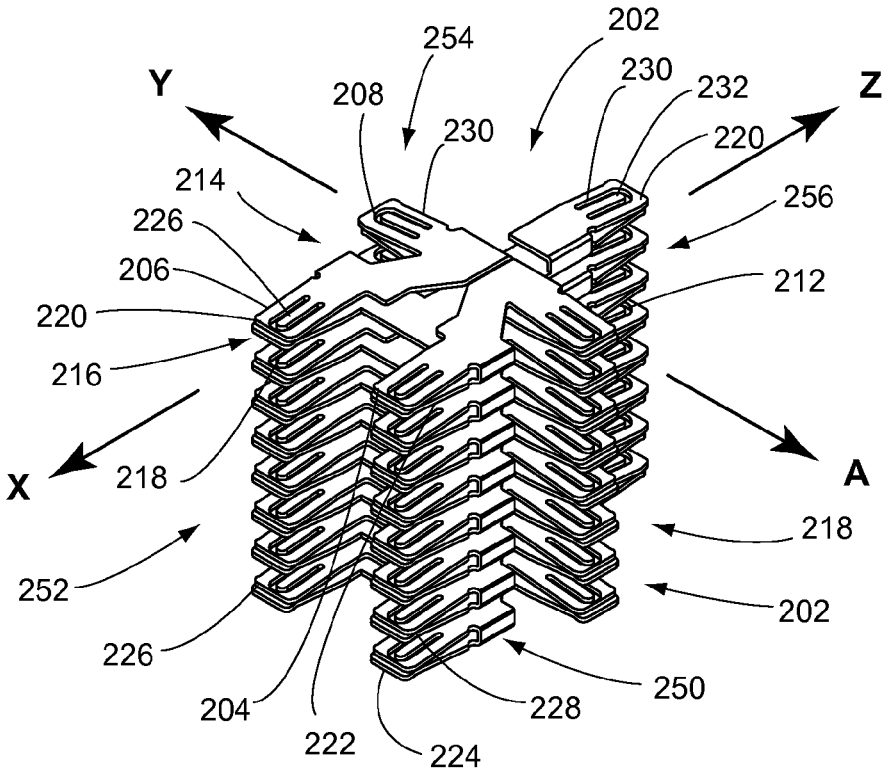
FIG. 12 is an upper, perspective view showing the horizontally disposed terminal sets and the vertically disposed terminal sets of FIG. 11.
Figure 13:
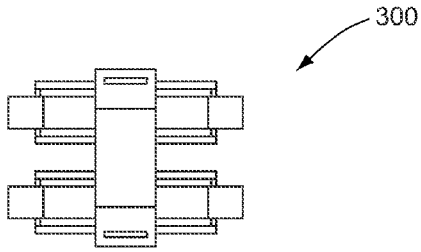
FIG. 13 is a plan view of a four-way raceway connector in accordance with the invention.
Figure 14:
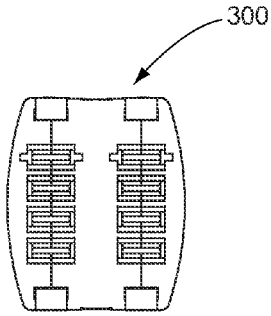
FIG. 14 is a left end view of the four-way connector shown in FIG. 13.
Figure 15:
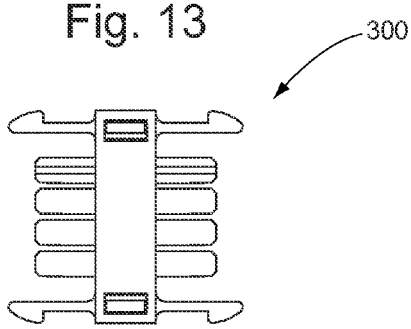
FIG. 15 is a front, elevation view of the four-way connector shown in FIG. 13.
Figure 16:
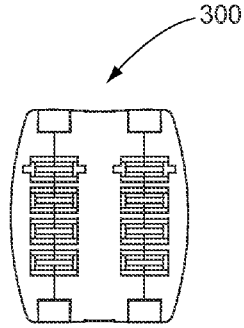
FIG. 16 is a right end view of the four-way connector shown in FIG. 13.
Figure 17:
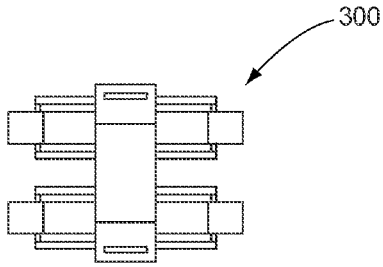
FIG. 17 is an underside view of the four-way connector shown in FIG. 13.
Figure 18:
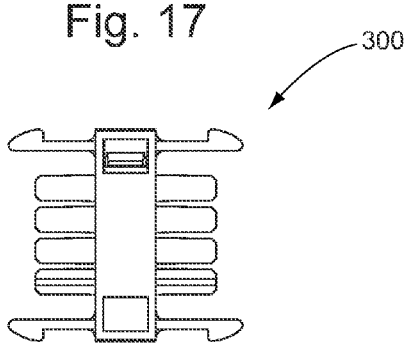
Figure 19:
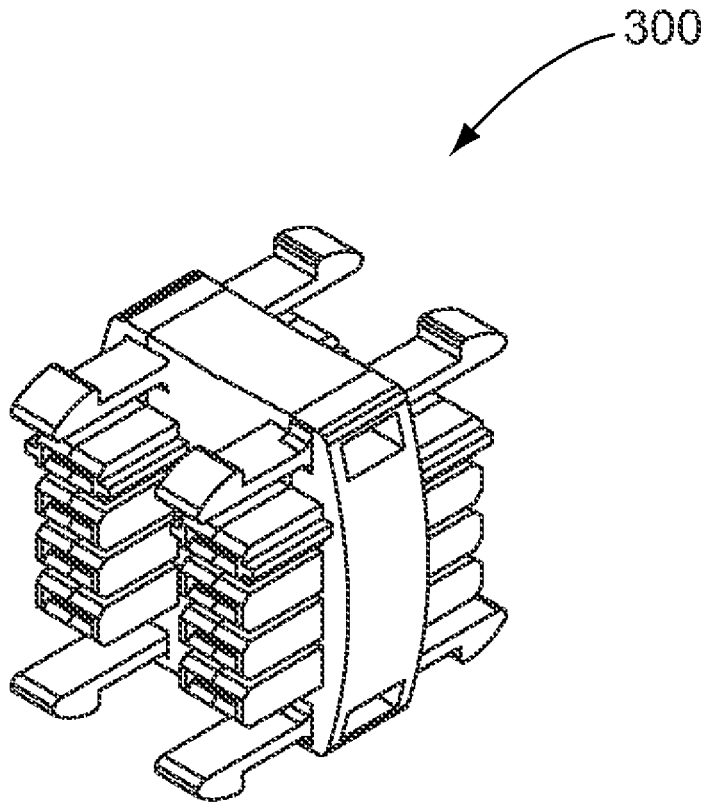
FIG. 19 is a right-side perspective view of the four-way raceway connector shown in FIG. 13.
Figure 20:
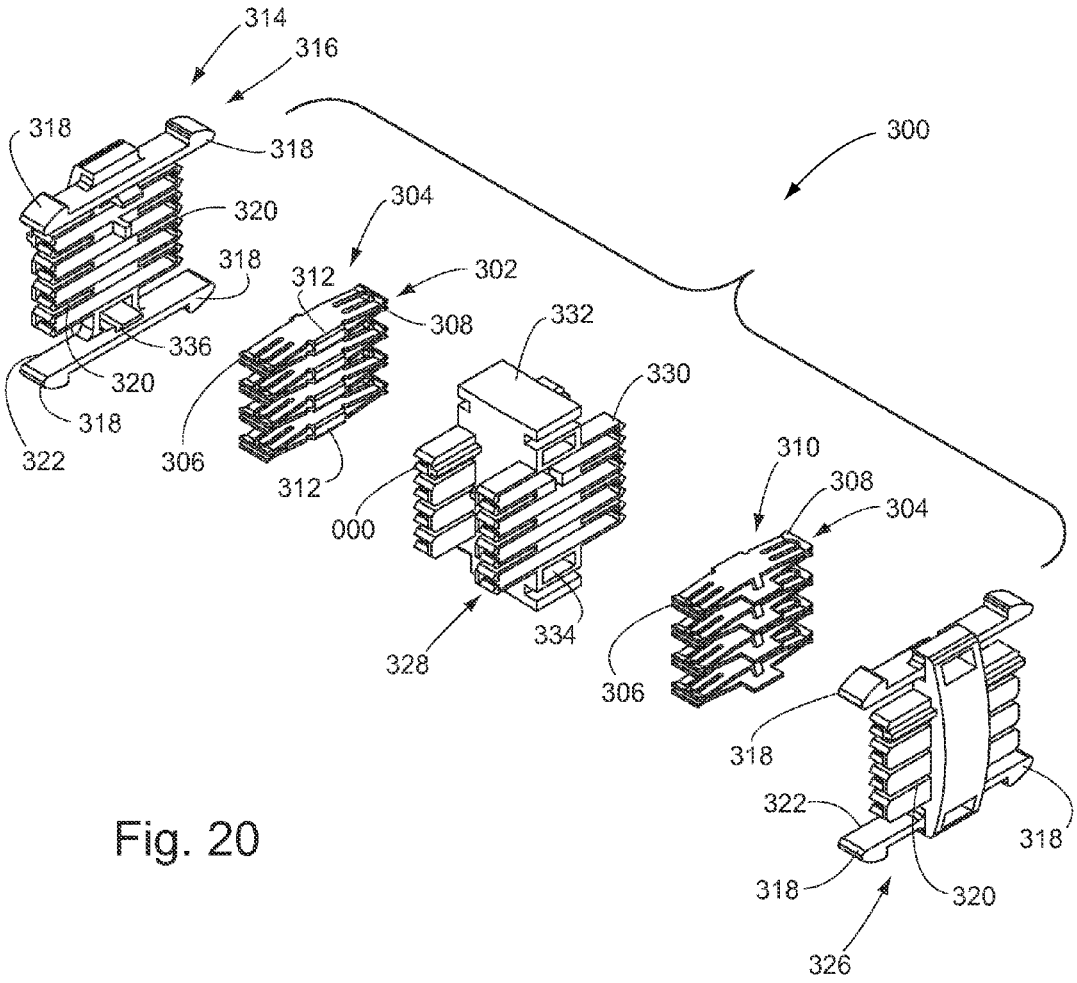
FIG. 20 is an exploded view of the four-way raceway connector shown in FIG. 13.

As particularly shown in FIG. 12, the eight first female terminals 204 extend outwardly in a direction shown in FIG. 12 by the arrow X. Correspondingly, second female terminals 206 are parallel to the first female terminals 204, and also extend outwardly in the direction X. Also, as particularly shown in FIG. 12, the third female terminals 208 extend outwardly in the direction shown by the arrow Y. The direction shown by the arrow Y can be characterized as being at an angle of 90° relative to the direction shown by arrow X. Correspondingly, the fourth female terminals 210 extend outwardly in a direction Z, shown by the arrow Z. This direction is 180° from the direction shown by arrow X. Finally, the fifth female terminals 212 extend outwardly in the direction shown by the arrow A. This direction can be characterized as being at 180° from the direction shown by arrow Y, and at 270° relative to the direction shown by arrow X. It should be noted that all of the female terminals 204-212 associated with one of the horizontally disposed five-way female terminal sets 202 are conductively connected to each other. Accordingly, if electrical power is applied to any one of the female terminals 204-212 associated with a terminal set 202, that power is available as output power at each of the other female terminals associated with the same female terminal set 202. In this manner, if power is applied to either the first female terminal 204 or second female terminal 206, then such power would be available at a female terminal which is directed at 0°, 90°, 180° or 270° from the female terminal to which power is applied.

Figure 10:
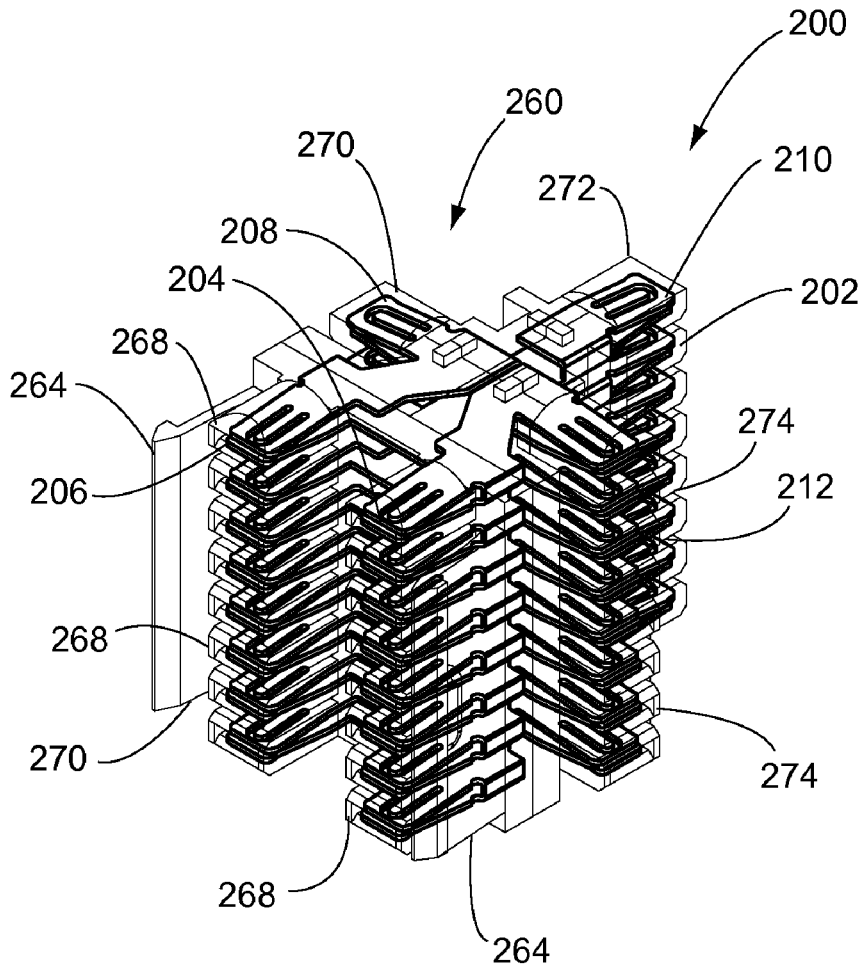
FIG. 10 is an upper, perspective view of a five-way raceway connector showing the relative positioning of the terminal sets within a connector housing.
Figure 11:
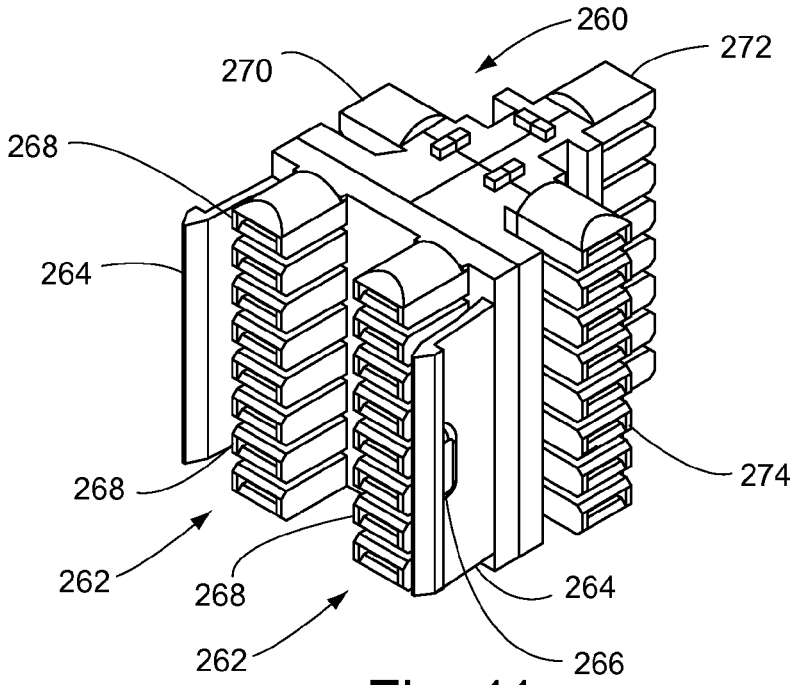
FIG. 11 is an upper, perspective view similar to FIG. 10, but showing a view of the raceway connector, as incorporated within the connector housing.

It should be noted that the particular raceway connector 200 shown in FIGS. 10, 11 and 12 includes eight five-way female terminal sets 202. Such a terminal set configuration would be useful for an eight-wire system. However, without departing from any of the novel concepts of the invention, any other number of horizontally disposed female terminal sets could be utilized.

In addition to the female terminal sets 202 primarily illustrated in FIGS. 10 and 12, the raceway connector 200 also includes a connector housing 260 as primarily shown in FIG. 11. Such a connector housing for use with two terminal sets is well known in the art, and is disclosed, for example, in my commonly owned U.S. Pat. No. 5,941,720 issued Aug. 24, 1999. The connector housing 260 includes a pair of connector blocks which extend in the direction shown by arrow X (in FIG. 12), with each connector block 262 adapted to receive the first vertical terminal set 250 and second vertical terminal set 252. Each connector block 262 is provided with a pair of side flanges 264. The side flanges 264 have slots 266 (only one of which is shown in FIG. 11) for purposes of engagement with male connector blocks (not shown) having male terminals to mate with the female terminals of the raceway connector 200. The housing 260 further includes a series of female terminal housings 268, each of which is adapted to receive one of the female terminals associated with the raceway connector 200.

In addition to the connector blocks 262, the housing 260 also includes a connector block 270 extending in the direction of arrow Y, connector block 272 extending in the direction of arrow Z and connector block 274 extending in the direction of arrow A. The connector block 270 is adapted to house the third vertical female terminal set 254. The connector block 272 is adapted house the fourth vertical female terminal set 256, and the connector block 274 is adapted to house the fifth vertical terminal set 258. The connector blocks 270, 272 and 274 can also include flanges such as the side flanges 264 or similar means for mechanically and releasably coupling a male terminal connector block to a corresponding one of these female terminal connector blocks. Further, if desired, the connector blocks can also be keyed, for purposes of ensuring that there can be no inappropriate connection or attempt for connections among terminals.

The four-way raceway connector 300 in accordance with the invention will now be described primarily with respect to FIGS. 13-22. To the extent appropriate for description and clarity, components of the raceway connector 300 which correspond to components of the electrical contact unit 100 and connector 200 will use identical reference numerals when possible.

Referring first primarily to FIGS. 13-18 and 20, the four-way raceway connector 300 includes a first vertical terminal set 302 having a series of four vertically disposed double end terminals 304. The double end terminals 304 correspond to terminals previously described with respect to the connector 100. The double end terminals 304 each have a first female connector 306 located at one end and a second female connector set 308 located at an opposing end. A second vertical terminal set 310 is also provided. The second vertical terminal set 310 also includes a set of four double end terminals 304, each having a first female connector 306 and a second female connector 308. Further, each of the double end terminals 304 includes a center connector 312 which is utilized to appropriately secure the terminal sets 302 and 310 to the entirety of the connector 300.

In addition to the vertical terminal sets 302, 310, the raceway connector 300 also includes a left outside housing 314 and a right outside housing 324. The left outside housing 314 is utilized to secure, in part, the first vertical terminal set 302. The housing 314 includes an upper contact strut. The upper contact strut 316 includes a pair of opposing connector tabs 318. The connector tabs 318 are utilized to releasably secure the raceway connector 300 to a set of junction blocks described in substantive paragraphs herein. A lower connector 322 is also provided in the form of a connector strut having a set of opposing connector tabs 318. The left outside housing 314 is secured to the first vertical terminal set 302 through partial insertion of the terminal set 302 into what is shown as the outer housing 320.

Correspondingly, a right side housing 324 is provided, which is the mirror image of the left outside housing 314. Still further, the raceway connector 300 includes a center connector 328 disposed between the first vertical terminal set 302 and the second vertical terminal set 310. The center connector 328 includes a series of center housings 330 which are positioned at an equal height with the vertical terminal sets 302, 310. In accordance with all of the foregoing, one side of each of the double end terminal 304 of the terminal sets 302, 310 can be secured within appropriate center housing slots 330. Correspondingly, the opposing sides of the double end terminals 304 can be secured within the outer housings 320 of the terminal sets 302, 310. To secure the center connector 328 to the housings 314, 324, connector tabs 336 mounted to the terminal sets can be releasably secured within the connector slots 334 shown in FIG. 20 as being part of the center connector 328. In accordance with all of the foregoing, the individual elements described herein can form the four-way raceway connector 300 as shown in its entirety in a standalone configuration in FIG. 19.

Figure 21:
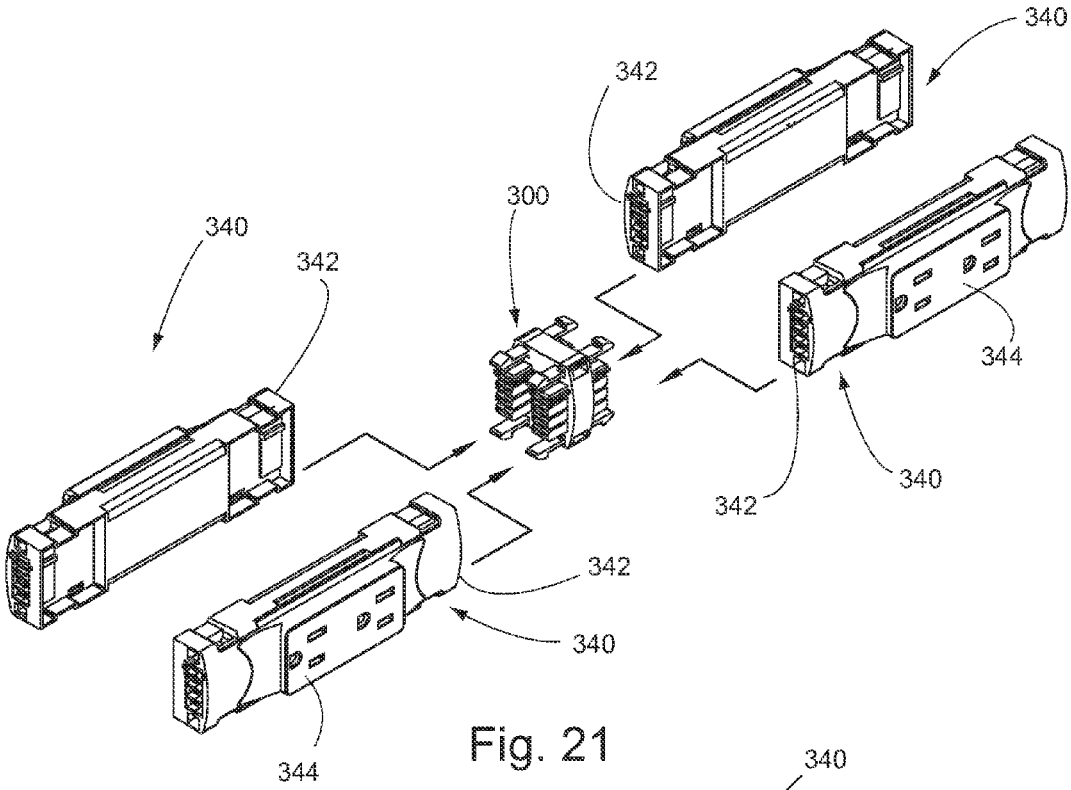
FIG. 21 is a perspective and exploded view of the four-way raceway connector shown in FIG. 13, in a relative position for interconnection with a set of four junction blocks.
Figure 22:
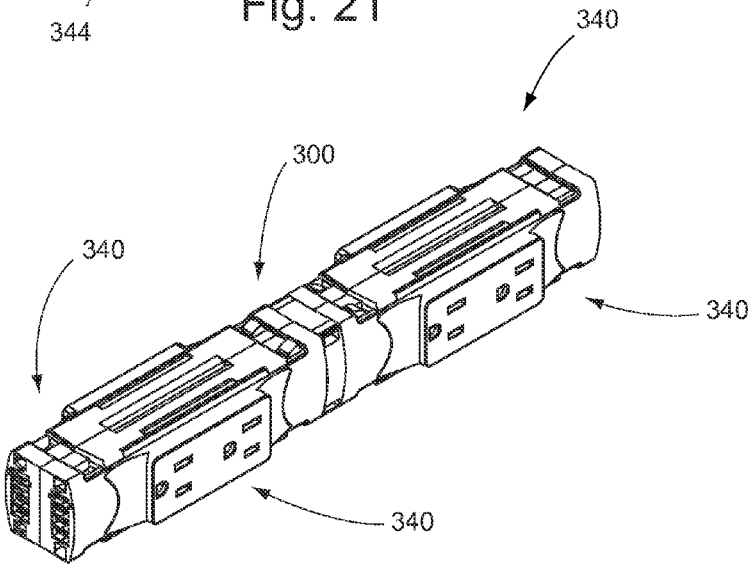
FIG. 22 is a perspective view similar to FIG. 21, but showing the four-way raceway connector in a fully assembled state with the four junction blocks.

To illustrate the use of the four-way extension 300, its relative position with respect to other elements of and electrical raceway are shown in FIGS. 21 and 22. Specifically, in FIG. 21, the raceway connector 300 is shown in a relative position for interconnection with a series of four junction blocks 340. Each of the junction blocks 340 can be connected in a relatively conventional manner to an incoming source of power or alternatively, can "pass through" power to other raceway elements. Also, the junction blocks 340 can include their own energy devices, such as the electrical outlet assemblies 344 shown in FIG. 21 on two of the junction blocks 340.

As further shown in FIG. 21, each of the junction blocks 340 includes a male connector 342. The male connector 342 are adapted to be received within the first and second female connectors 306, 308, previously described with respect to FIG. 20. In this manner, the four-way connector 300 can be utilized to interconnect the four junction blocks 340 as shown in a fully assembled state in FIG. 22.

It will be apparent to those skilled in the pertinent arts that other embodiments of raceway connectors in accordance with the invention can be achieved. That is, the principles of accordance with the invention are not limited to the specific embodiments described herein. It will be apparent to those skilled in the art that modifications and other variations of the above-described illustrative embodiments of the invention may be effected without departing from the spirit and scope of the novel concepts of the invention.

The embodiments of the invention in which an exclusive property or privilege is claimed are defined as follows:

1. A raceway connector adapted to conductively receive and transmit electrical power, said raceway connector comprising:

first means for receiving power from an external source;

second means conductively connected to said first means for transmitting said power and applying said power to external components;

said first means comprises a first terminal;

said second means comprises three terminals identified as second, third and fourth terminals;

each of said first, second, third and fourth terminals have incoming power means for receiving incoming power from said external source;

said first terminal extends outwardly from said raceway connector in a first direction; said second terminal extends outwardly from said raceway connector in a second direction, said second direction being parallel to said first direction;

said third terminal extends outwardly from said raceway connector in a third direction, said third direction being at an angle of 180° relative to said first direction;

said fourth terminal extends outwardly from said raceway connector in a fourth direction, said fourth direction being at an angle of 180° relative to said first direction; and each of said first, second, third and fourth terminals is a female terminal.

2. A raceway connector in accordance with claim 1, characterized in that each of said first, second, third and fourth terminals are each conductively connected to each other.

3. A raceway connector in accordance with claim 1, characterized in that said connector further comprises a plurality of four-way terminal sets, each of said terminal sets being disposed above or below an adjacent one of said terminal sets, and each of said terminal sets comprising said first terminal, said second terminal, said third terminal and said fourth terminal.

4. A raceway connector in accordance with claim 3, characterized in that each of said four-way terminal sets is isolated from each of the other of said plurality of four-way terminal sets.

5. A raceway connector in accordance with claim 3, characterized in that said plurality of four-way terminal sets is four in number.

6. A raceway connector in accordance with claim 1, characterized in that said raceway connector comprises:

a first vertical terminal set formed as a plurality of vertically disposed first terminals;

a second vertical terminal set formed as a plurality of said second terminals;

a third vertical terminal set formed as a plurality of said third terminals; and a fourth vertical terminal set formed as a plurality of fourth terminals.

7. A raceway connector in accordance with claim 1, characterized in that said raceway connector comprises:

a plurality of horizontally disposed four-way terminal sets, each of said terminal sets comprising said first, second, third and fourth terminals; and said raceway connector further comprises a connector housing having individual terminal housings for each terminal of said raceway connector.

8. A raceway connector adapted to conductively receive and transmit electrical power, said raceway connector comprising:

first means for receiving power from an external source;

second means conductively connected to said first means for transmitting said power and applying said power to external components;

said first means comprises a first terminal;

said second means comprises three terminals identified as second, third and fourth terminals;

said first, second, third and fourth terminals each comprise:

upper means extending forwardly, and having a lower surface with at least first, second and third upper contact locations formed thereon;

lower means extending forwardly and conductively interconnected to and positioned substantially directly below said upper means, and having an upper surface with at least first, second and third lower contact locations formed thereon; and each terminal is sized and configured so that a blade terminal is insertable between said upper means and said lower means, and is adapted to conductively contact said terminal at said first, second and third upper and lower contact locations, so as to form at least six conductive and electrical contact locations with said terminal.

* * * * *